US007829250B2

(12) United States Patent
Law et al.

(10) Patent No.: US 7,829,250 B2
(45) Date of Patent: Nov. 9, 2010

(54) OPTICALLY TRANSPARENT SOLVENT COATABLE CARBON NANOTUBE GROUND PLANE

(75) Inventors: Kock-Yee Law, Penfield, NY (US); John S. Facci, Webster, NY (US); Edward F. Grabowski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 426 days.

(21) Appl. No.: 11/963,055

(22) Filed: Dec. 21, 2007

(65) Prior Publication Data

US 2009/0162761 A1 Jun. 25, 2009

(51) Int. Cl.
*G03G 13/14* (2006.01)

(52) U.S. Cl. ..... 430/48; 430/57.1

(58) Field of Classification Search ..... 430/48, 430/57.1; 399/130

See application file for complete search history.

(56) References Cited

U.S. PATENT DOCUMENTS 4,286,033 A 8/1981 Neyhart et al.
4,291,110 A 9/1981 Lee
4,338,387 A 7/1982 Hewitt
5,063,128 A * 11/1991 Yuh et al. ..... 430/63
2007/0037081 A1 2/2007 Mishra et al.
2009/0129816 A1* 5/2009 Facci ..... 399/159

* cited by examiner

*Primary Examiner*—Hoa V Le
(74) *Attorney, Agent, or Firm*—MH2 Technology Law Group LLP

(57) ABSTRACT

In accordance with the invention, there are xerographic photoreceptors, image forming apparatus, and methods of forming an image on image. The xerographic photoreceptor can include a substrate and a conductive ground plane having an optical transparency disposed over the substrate, the conductive ground plane including a carbon nanotube layer, such that machine cycling of the xerographic photoreceptor can produce less than approximately a 10% change in the optical transparency of the conductive ground plane after about 100,000 or more machine cycles. The xerographic photoreceptor can also include a photosensitive layer disposed over the conductive ground plane, wherein the photosensitive layer can include a charge generator material and a charge transport material.

25 Claims, 5 Drawing Sheets

OPTICALLY TRANSPARENT SOLVENT COATABLE CARBON NANOTUBE GROUND PLANE

FIELD OF THE INVENTION

The present invention relates to photoreceptors and, more particularly, to optically transparent conductive ground plane including a carbon nanotube layer for use in an electrophotographic apparatus.

BACKGROUND OF THE INVENTION

One of the shortcomings of xerographic ground planes based on evaporated metal film is that the metal film can be converted to its oxide with xerographic cycling. Ground plane materials such as Al, Ti, Zr are electrochemically active and can be oxidized to metal oxides easily. Holes traversing the photoreceptor in combination with ambient water electrochemically can convert the metals to their optically transparent and insulating oxides resulting in a change in charge acceptance and transparency. Long print runs of a single image can lead to variations in optical transparency corresponding to image content. Consequently, both erase illumination (for photoreceptor belts) and ground plane conductivity can vary spatially according to image content leading to image ghosts which can limit photoreceptor belt life. Suitable materials for non-electrochemically reactive optically transparent conductive ground planes are limited. Dispersed carbon particles are non-electrochemically reactive but they are unsuitable because of the poor optical transparency of dispersed carbon films. Alternative optically transparent conductive ground planes formed of, for example, cuprous iodide and conducting polymers including polypyrrole and polyaniline also have issues of reproducibility and cost as well as the relative immaturity of the technology. Ground planes formed of sputtered indium tin oxide (ITO) have problems due to electrical cycling because the indium can migrate with DC current flow. As a result, small insulating areas develop in the ground plane that turn into photoreceptor print defects. Hence, there is a need for improved ground planes.

Furthermore, one of the shortcomings of the image on image (IOI) approach to color xerography is the absorption of some of the illumination used to write the xerographic image by the previously applied toner layers. The amount of yellow, cyan, and black deposited by a specific laser exposure depends on the amount of magenta previously applied. The amount of cyan applied depends on the pervious magenta and yellow toner layer thickness levels. This issue with IOI can be eliminated by exposing the photoreceptor from the inside of the belt module through the back of the belt. However, cost effective illumination is difficult with the existing photoreceptors which only transmits about 10% of the incident illumination.

Accordingly, there is a need for developing transparent ground planes that are non-oxidizable and stable against temperature and humidity variations.

SUMMARY OF THE INVENTION

In accordance with the invention, there is a xerographic photoreceptor. The xerographic photoreceptor can include a substrate and a conductive ground plane having an optical transparency disposed over the substrate, the conductive ground plane including a carbon nanotube layer, such that machine cycling of the xerographic photoreceptor can produce less than approximately a 10% change in the optical transparency of the conductive ground plane after about 100,000 or more machine cycles. The xerographic photoreceptor can also include a photosensitive layer disposed over the conductive ground plane, wherein the photosensitive layer can include a charge generator material and a charge transport material.

According to another embodiment of the present teachings, there is an image forming apparatus. The image forming apparatus can include a xerographic photoreceptor wherein the xerographic photoreceptor can include a conductive ground plane having an optical transparency disposed over a substrate, the conductive ground plane can include a carbon nanotube layer, such that machine cycling of the xerographic photoreceptor can produce less than approximately a 10% change in the optical transparency of the conductive ground plane after about 100,000 or more machine cycles. The image forming apparatus can also include one or more charging stations disposed on a first side of the xerographic photoreceptor for uniformly charging the xerographic photoreceptor and one or more imaging stations disposed after each of the one or more charging stations to form a latent image on the xerographic photoreceptor. The image forming apparatus can further include one or more development subsystems disposed on the first side of the xerographic photoreceptor after each of the one or more imaging stations for converting the latent image to a visible image on the xerographic photoreceptor, a transfer station disposed on the first side of the xerographic photoreceptor for transferring and fixing the visible image onto a media, and a pre-charge erase station to erase any residual charge.

According to yet another embodiment of the present teachings, there is a method of forming an image on image. The method can include providing a xerographic photoreceptor including a conductive ground plane having an optical transparency disposed over a substrate, the conductive ground plane can include a carbon nanotube layer, such that machine cycling of the xerographic photoreceptor produces less than approximately a 10% change in the optical transparency of the conductive ground plane after about 100,000 or more machine cycles. The method can also include uniformly charging a first side of the xerographic photoreceptor, forming a first latent image on the first side of the xerographic photoreceptor, and converting the first latent image to a first visible image having a first color on the first side of the xerographic photoreceptor. The method can further include repeating the above steps to form one or more visible images over the first visible image, wherein each of the one or more visible images has a unique color, transferring the one or more visible images onto a media, and erasing residual charge on the first side of the xerographic photoreceptor, by exposing a second side of the xerographic photoreceptor to light, wherein the second side is opposite to the first side.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1A:
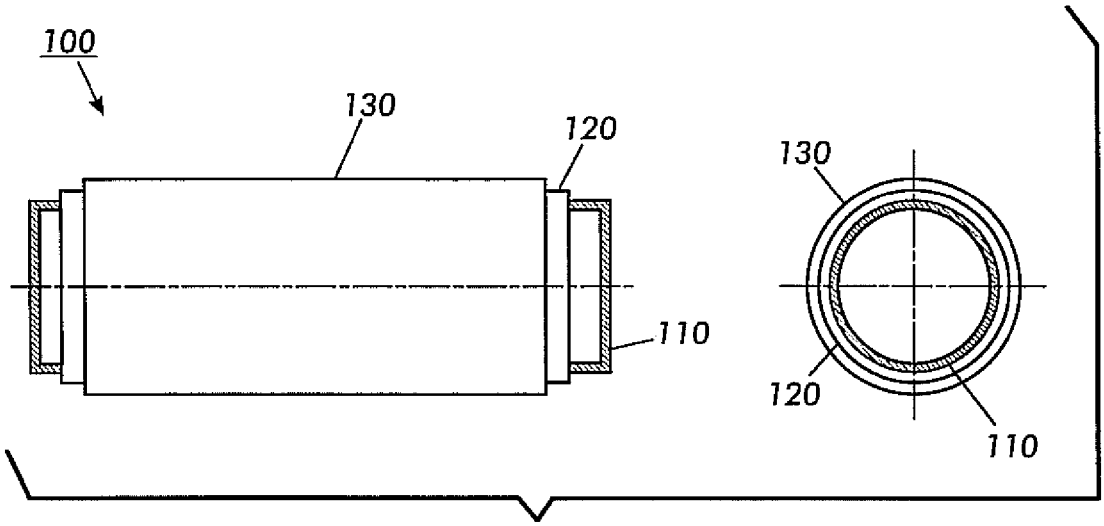
FIGS. 1A and 1B illustrate exemplary xerographic drum photoreceptors, according to various embodiments of the present teachings.
Figure 1B:
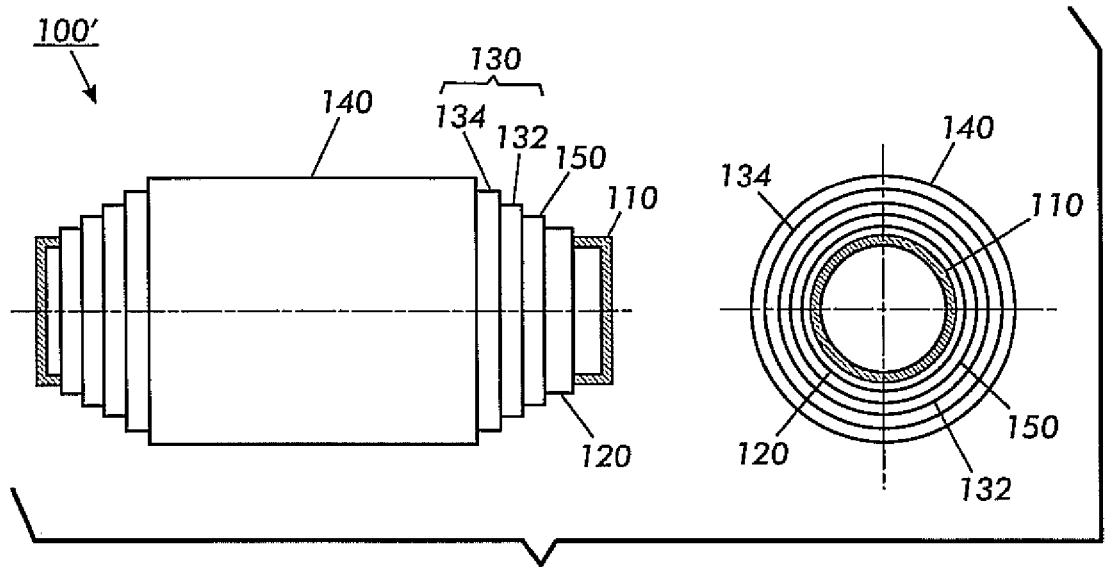

FIGS. 1A and 1B illustrate exemplary xerographic drum photoreceptors. In particular, exemplary xerographic drum photoreceptors 100, 100' can include a substrate 110 and a conductive ground plane 120 having an optical transparency disposed over the substrate 110. In various embodiments, the conductive ground plane 120 can include a carbon nanotube layer (not shown), such that machine cycling of the xerographic drum photoreceptor 100, 100' can produce less than approximately a 10% change in the optical transparency of the conductive ground plane 120 after about 100,000 or more machine cycles. In various embodiments the substrate 110 can include one or more of aluminum, aluminized plastic, paper, steel, conductive plastic, plastic, wood, ceramic, glass, recycled steel, and recycled zinc. In various embodiments, the conductive ground plane 120 can have an electrical surface resistivity of less than approximately 300 ohms per square and the optical transparency of more than approximately 80% in the visible to near infrared range. In some embodiments, the conductive ground plane 120 can have an electrical surface resistivity of less than approximately 10,000 ohms per square and the optical transparency from approximately 10% to approximately 40% in the visible to near infrared range. In other embodiments, the conductive ground plane 120 can have the optical transparency from approximately 40% to approximately 97%. The conductive ground plane 120 can have a thickness from about 0.01 μm to about 20 μm and in some cases from about 0.05 μm to about 10 μm.

In various embodiments, the carbon nanotube layer can be formed by depositing a thin layer of carbon nanotubes over one or more optically transparent supporting layers using conventional deposition techniques such as, for example, dip coating, spray coating, spin coating, web coating, draw down coating, flow coating, and extrusion die coating. Non-limiting examples of optically transparent supporting layers include polyethylene, oriented polyethylene terephthalate (PET), oriented Polyethylene Naphthalate (PEN), polycarbonate, and other synthetic polymeric materials. In some embodiments, the carbon nanotube layer can be formed of a carbon nanotube composite, including but not limited to carbon nanotube polymer composite and carbon nanotube filled resin. In other embodiments, the carbon nanotube layer can be formed by forming a first layer of conductive carbon nanotube network over the substrate 110, wherein the first layer of conductive carbon nanotube network has an electrical conductivity and forming a second layer of polymeric coating over the first layer of conductive carbon nanotube network, wherein the second layer of polymeric coating stabilizes the first layer of conductive carbon nanotube network without changing the electrical conductivity of the first layer of conductive carbon nanotube network.

According to various embodiments, the carbon nanotube layer can include one or more of a plurality of single walled carbon nanotubes (SWNT), a plurality of double walled carbon nanotubes (DWNT), and a plurality of multi walled carbon nanotubes (MWNT). One of ordinary skill in the art would know that as-synthesized carbon nanotubes after purification is a mixture of carbon nanotubes structurally with respect to number of walls, diameter, length, chirality, and defect rate. It is the chirality that dictates whether the carbon nanotube is metallic or semiconductor. Statistically, one can get about 33% metallic carbon nanotubes. Carbon nanotubes can have a diameter from about 0.5 nm to about 50 nm and in some cases from about 1.0 nm to about 10 nm and can have a length from about 10 nm to about 5 mm and in some cases from about 200 nm to about 10 μm. In certain embodiments, the concentration of carbon nanotubes in the carbon nanotube layer can be from about 0.5 weight % to about 99 weight % and in some cases can be from about 0.5 weight % to about 50 weight % and in some other cases from about 1 weight % to about 20 weight %. The carbon nanotube layer can have a thickness in the range of about 20 nm to about 20 μm.

The conductive ground plane 120 including the carbon nanotube layer can have several advantages over conventional metal films used for conductive ground planes. Carbon nanotubes exhibit many desirable properties for conductive ground plane 120 such as high optical transparency, electrical conductivity, non-oxidizable, flexibility, and high tensile strength. Furthermore, the conductive ground plane 120 including the carbon nanotube layer can enable the use of insulating substrates or conductive substrates that have not expensive surface conditioning steps. Existing xerographic drum substrates require surface conditioning with a diamond lathe bit and subsequent chemical cleaning to produce a xerographically uniform substrate.

Referring back to FIGS. 1A and 1B, the exemplary xerographic drum photoreceptors 100, 100' can also include a photosensitive layer 130 disposed over the conductive ground plane 120, wherein the photosensitive layer can include a charge generator material and a charge transport material. In some embodiments, the photosensitive layer 130 can include a charge generator layer 132 disposed over the conductive ground plane 120 and a charge transport layer 134 disposed over the charge generator layer 132, as shown in FIG. 1B. In other embodiments, the photosensitive layer 130 can include a charge generator layer 132 disposed over a charge transport layer 134. Yet, in some other embodiments, the charge generator material and the charge transport material can be dispersed in a common matrix such as polymer or resin. Non-limiting examples of polymer or resin can include polycarbonate, polystyrene, polyvinyl carbazole, and the like. The charge generating materials can include organic pigments and organic dyes such as, for example, hydroxygallium phthalocyanine, vanadyl phthalocyanine, titanyl phthalocyanine, metal-free-pthalocyanine, perylenes such as benzimidazole perylene and congeners, squaraine dyes, pigments, and the like, and mixtures thereof. The charge transporting materials can include organic arylamine compounds such as, for example, triarylamines including its alkyl, aryl, alkoxy, aryloxy, halogen, amino substituted congeners, arylamine substituted biphenyl and terphenyl, and the like, and the mixtures thereof. The photosensitive layer 130 can have a thickness from about 5 μm to about 50 μm and in some cases from about 15 μm to about 35 μm.

In various embodiments, the exemplary xerographic drum photoreceptors 100, 100' can also include an undercoat layer 150 disposed over the conductive ground plane 120 and under the photosensitive layer 130, as shown in FIG. 1B. In some embodiments, the undercoat layer 150 can be a blocking layer. Any suitable positive charge (hole) blocking layer capable of forming an effective barrier to the injection of holes from the adjacent conductive ground plane 120 into the photoconductive or photogenerator layer 132 can be utilized. Typical hole blocking materials are described in U.S. Pat. Nos. 4,338,387; 4,286,033; and 4,291,110; and U.S. Patent Application No. 20070037081, the disclosures of which are hereby incorporated by reference in their entireties. The blocking layer can be applied by any suitable conventional technique, such as, for example, extrusion die coating, flow coating, spraying, dip coating, draw bar coating, gravure coating, silk screening, air knife coating, reverse roll coating, vacuum deposition, chemical treatment, and the like. The hole blocking layer can have a thickness from about 5 nm to about 10 μm. In other embodiments, the undercoat layer 150 can be an adhesive layer. Yet, in some other embodiments, the undercoat layer 150 can include a blocking layer disposed over the conductive ground plane 120 and an adhesive layer disposed over the blocking layer. Any suitable material can be used for the adhesive layer, including, but not limited to polyester and copolyester resins. Any suitable technique can be used to deposit the adhesive layer, such as, for example, extrusion die coating, flow coating, gravure coating, spraying, dip coating, roll coating, and wire wound rod coating. The adhesive layer can have a thickness from about 0.01 μm to about 900 μm, and in some cases from about 0.03 μm to about 1 μm.

In various embodiments, the exemplary xerographic drum photoreceptors 100, 100' can also include an overcoat layer 140 disposed over the photosensitive layer 130, as shown in FIG. 1B. The overcoat layer 140 can provide xerographic drum photoreceptor 100' surface protection as well as resistance to abrasion. In some embodiments, the overcoat layer 140 or the charge transport layer 134 can include nanoparticles including, but not limited to, silica, metal oxides, Acumist™ (waxy polyethylene particles), and PTFE as a dispersion. The nanoparticles can be used to enhance the lubricity and wear resistance of the overcoat layer 140 and the charge transport layer 134. The particle dispersion concentrated in the top vicinity of the charge transport layer 134 can be up to about 10 weight percent of the weight or one tenth the thickness of the charge transport layer 134 to provide optimum wear resistance without causing a deleterious impact on the electrical properties. Where a separate overcoat layer 140 is employed, it can include a similar resin used for the charge transport layer 134 or a different resin and be from about 1 μm to about 2 μm in thickness.

As used herein, the term "machine cycle" refers to a complete process of forming an image. One machine cycle refers to uniformly charging a xerographic photoreceptor 100, 100', forming a latent image on the xerographic photoreceptor 100, 100', converting the latent image to a visible image on the xerographic photoreceptor 100, 100', transferring the visible image onto a media, and erasing residual charge on the xerographic photoreceptor 100, 100'. After a desired number of machine cycling of the xerographic photoreceptor 100, 100', optical transmission of the xerographic photoreceptor 100, 100' can be measured by first removing all the layers except the conductive ground plane 120 using a solvent and then measuring the transmission of the conductive ground plane 120 using a spectrophotometer, such as, for example, Lambda 900 (PerkinElmer, Waltham, Mass.). One of ordinary skill in the art would know that there are other methods of determining optical transmission of the xerographic photoreceptor 100, 100'.

Figure 2A:
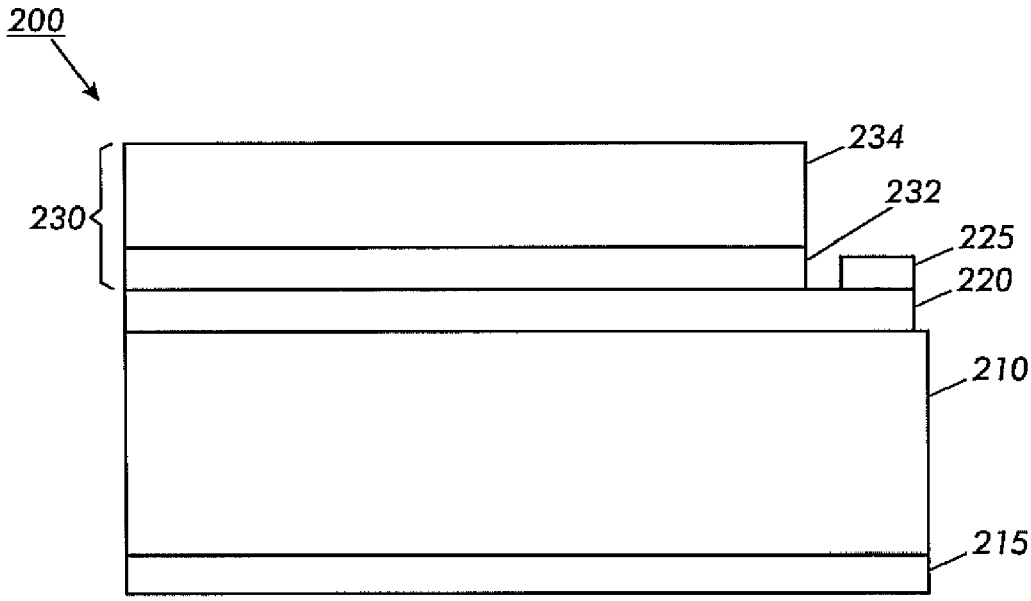
FIGS. 2A and 2B illustrate exemplary xerographic belt photoreceptors, according to various embodiments of the present teachings.
Figure 2B:
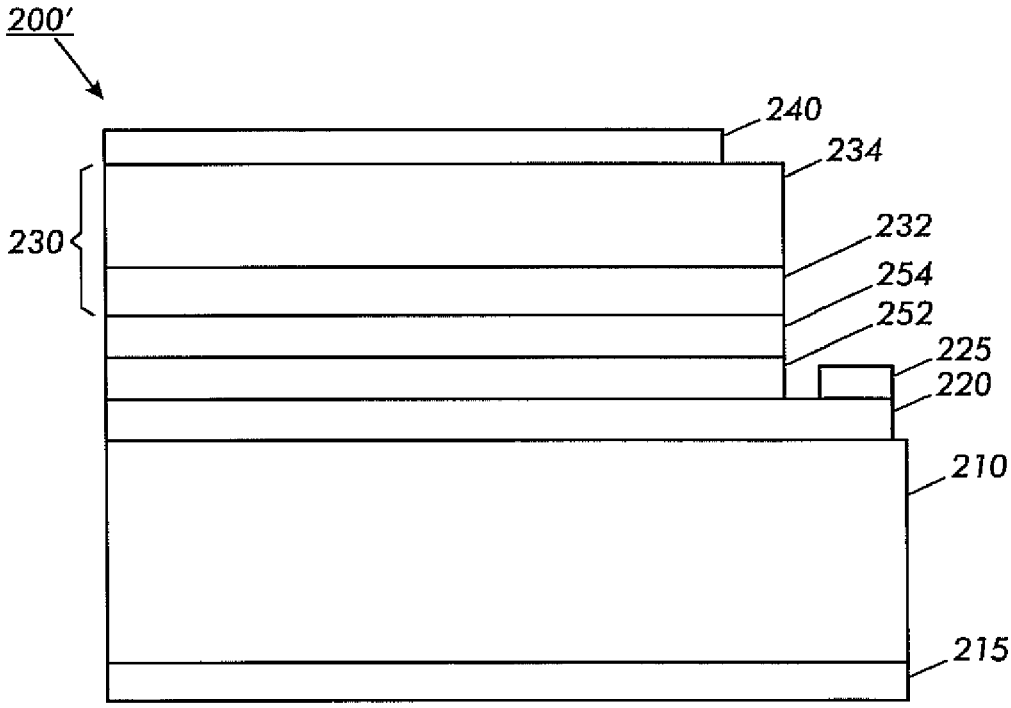

FIGS. 2A and 2B illustrate exemplary xerographic belt photoreceptors 200, 200'. The exemplary xerographic belt photoreceptors 200, 200' can include a substrate 210 and a conductive ground plane 220 having an optical transparency disposed over the substrate 210. In various embodiments, the conductive ground plane 220 can include a carbon nanotube layer (not shown), such that machine cycling of the xerographic belt photoreceptor 200, 200' can produce less than approximately a 10% change in the optical transparency of the conductive ground plane 120 after about 100,000 or more machine cycles. In some embodiments, the substrate 210 can be formulated entirely of an electrically conductive material, or it can be an insulating material including inorganic or organic polymeric materials, such as, for example, MYLAR™, a commercially available biaxially oriented polyethylene terephthalate from DuPont, or polyethylene naphthalate available as KALEDEX 2000, or a combination. In some embodiments, the conductive ground plane 220 can have the optical transparency from approximately 10% to approximately 40%. In other embodiments, the conductive ground plane 220 can have the optical transparency from approximately 40% to approximately 97%. In various embodiments, the conductive ground plane 220 can have an electrical surface resistivity of less than approximately 300 ohms per square and the optical transparency of more than approximately 80% in the visible to near infrared range. In some embodiments, the conductive ground plane 220 can have the electrical surface resistivity of less than approximately 10,000 ohms per square and the optical transparency from approximately 10% to approximately 40%. In other embodiments, the conductive ground plane 220 can have the optical transparency from approximately 40% to approximately 97%. The conductive ground plane 220 can have a thickness from about 0.01 μm to about 20 μm and in some cases from about 0.05 μm to about 5 μm.

The exemplary xerographic belt photoreceptors 200, 200' as shown in FIGS. 2A and 2B can also include a photosensitive layer 230 disposed over the conductive ground plane 220 and a ground strip layer 225 electrically connected to the conductive ground plane 220, wherein the ground strip layer can include a carbon nanotube layer. The ground strip layer 225 can also include a polymer binder filled with conductive metal, carbon, or graphite particles. In some embodiments, the photosensitive layer 230 can include a charge generator layer 232 disposed over the conductive ground plane 220 and a charge transport layer 234 disposed over the charge generator layer 232, as shown in FIGS. 2A and 2B. In other embodiments, the photosensitive layer 230 can include a charge generator layer 232 disposed over a charge transport layer 234. Yet in some other embodiments, the photosensitive layer 230 can include the charge generator material and the charge transport material dispersed in a common matrix such as polymer or resin. The photosensitive layer 230 can have a thickness from about 5 μm to about 50 μm and in some cases from about 15 μm to about 35 μm.

The exemplary xerographic belt photoreceptors 200, 200' as shown in FIGS. 2A and 2B can also include an anti-curl layer 215. Any suitable material can be used for the anti-curl layer 215. U.S. Patent Application No. 20070037081 describes some exemplary anti-curl layers, the disclosure of which is incorporated herein by reference in its entirety. The exemplary xerographic belt photoreceptors 200, 200' can also include one or more of a blocking layer 252 disposed over the conductive ground plane 220, an adhesive layer 254 disposed over the blocking layer 252, and an overcoat layer 240 disposed over the photosensitive layer 230, as shown in FIG. 2B.

Figure 3:
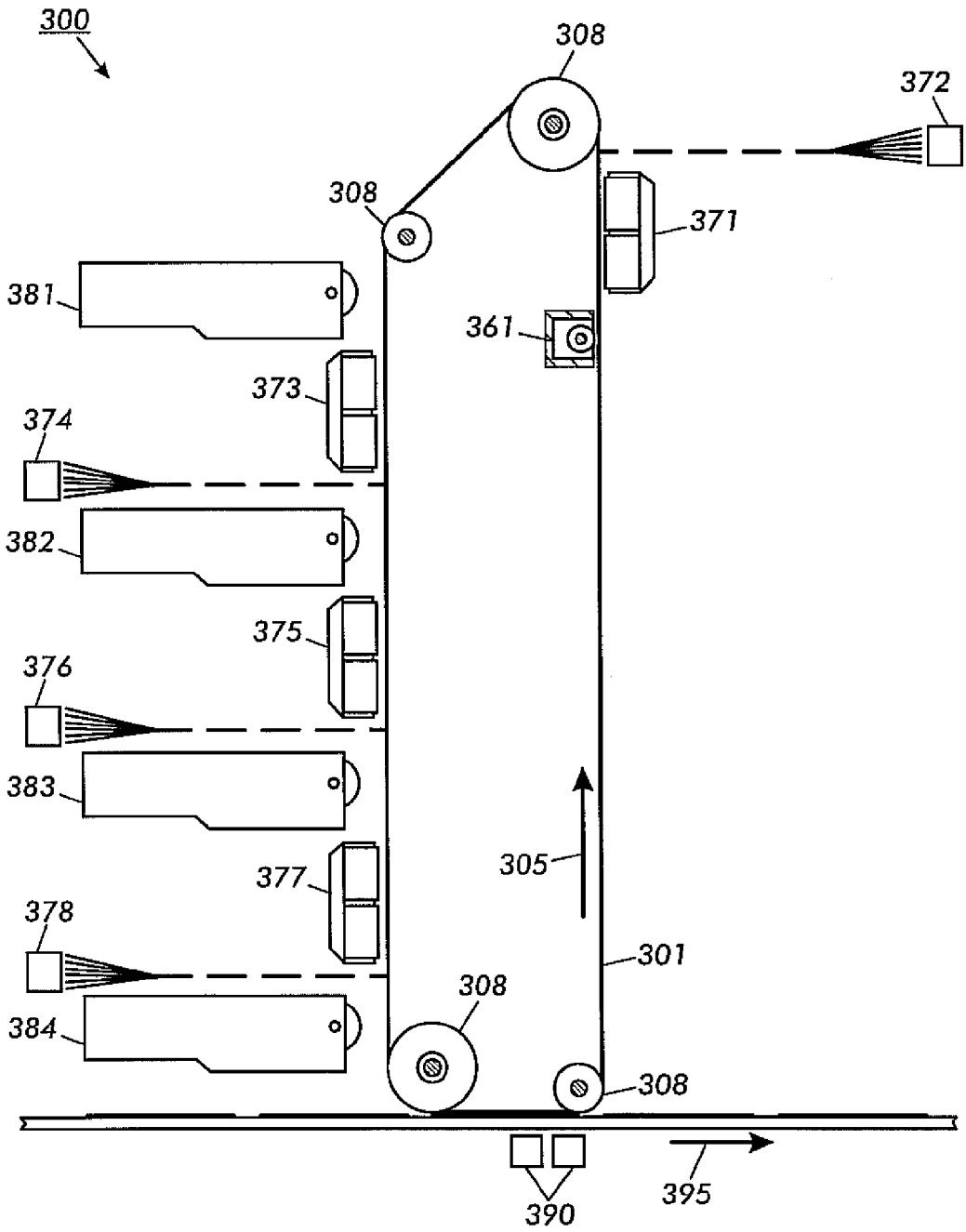
FIG. 3 schematically illustrates an exemplary image forming apparatus, in accordance with the present teachings.
Figure 5:
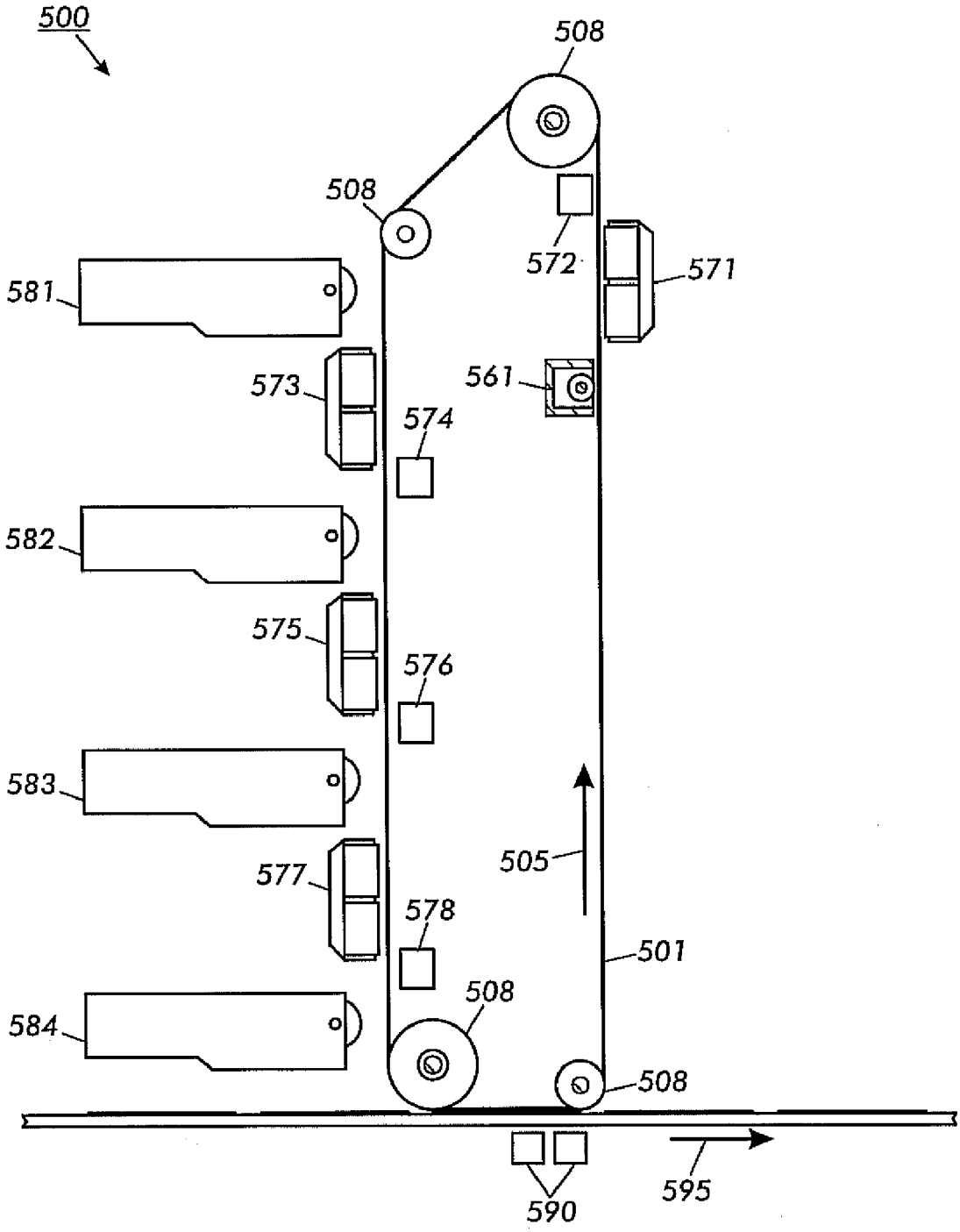
FIG. 5 schematically illustrates another exemplary image forming apparatus, in accordance with the present teachings.

FIGS. 3 and 5 schematically illustrate exemplary image forming apparatus 300, 500. The image forming apparatus 300, 500 can include a xerographic photoreceptor 301, 501 including a conductive ground plane having an optical transparency disposed over a substrate. In various embodiments, the conductive ground plane can include a carbon nanotube layer, such that machine cycling of the xerographic photoreceptor 301, 501 can produce less than approximately a 10% change in the optical transparency of the conductive ground plane after about 100,000 or more machine cycles. In various embodiments, the conductive ground plane of the xerographic photoreceptor 301, 501 can include a first layer of conductive carbon nanotube network having an electrical conductivity over a substrate, a second layer of polymeric coating over the first layer of conductive carbon nanotube network, wherein the second layer of polymeric coating stabilizes the first layer of conductive carbon nanotube network without changing the electrical conductivity of the first layer of conductive carbon nanotube network. In other embodiments, the xerographic photoreceptor 301, 501 can include a photosensitive layer disposed over the conductive ground plane, wherein the photosensitive layer can include a charge generator material and a charge transport material. In some embodiments, the optical transparency of the conductive ground plane can be from approximately 10% to approximately 40%. In other embodiments, the optical transparency of the conductive ground plane can be more than approximately 40%.

The image forming apparatus 300, 500 can also include one or more charging stations 371, 373, 375, 377, 571, 573, 575, 577 disposed on a first side of the xerographic photoreceptor 301, 501 for uniformly charging the xerographic photoreceptor 301, 501 and one or more imaging stations 372, 374, 376, 378, 572, 574, 576, 578 disposed after each of the one or more charging stations 371, 373, 375, 377, 571, 573, 575, 577 to form a latent image on the xerographic photoreceptor 301, 501. In some embodiments, one or more imaging stations 372, 374, 376, 378 can be disposed on the first side of the xerographic photoreceptor 301 after each of the one or more charging stations 371, 373, 375, 377, as shown in FIG. 3. In other embodiments, one or more imaging stations 572, 574, 576, 578 can be disposed on a second side of the xerographic photoreceptor 501 after each of the one or more charging stations 571, 573, 575, 577, as shown in FIG. 5, wherein the second side is opposite to the first side. The image forming apparatus 300, 500 can further include one or more development subsystem 381, 382, 383, 384, 581, 582, 583, 584 disposed on the first side of the xerographic photoreceptor 301, 501 after each of the one or more imaging stations 372, 374, 376, 378, 572, 574, 576, 578 for converting the latent image to a visible image on the xerographic photoreceptor 301, 501. In various embodiments, the first development subsystem 381, 581 can be magenta, the second development subsystem 382, 582 can be yellow, the third development subsystem 383, 583 can be cyan, and the fourth development subsystem 384, 584 can be black. The image forming apparatus 300, 500 can also include a transfer station 390, 590 disposed on the first side of the xerographic photoreceptor 301, 501 for transferring and fixing the visible image onto a media and a pre-charge erase station 361, 561 disposed on the second side of the xerographic photoreceptor 301, 501 to erase any residual charge which might exist, as shown in FIGS. 3 and 5. Furthermore, the exemplary image forming apparatus 300, 500 can also include one or more rollers 308, 508 over which the xerographic photoreceptor 301, 501 can be mounted and traveled along, as shown in FIGS. 3 and 5.

In various embodiments, the image forming apparatus 300, 500 can include a xerographic drum photoreceptor (not shown) including one or more imaging stations and a pre-charge erase station disposed on the inside of the xerographic drum photoreceptor, wherein the one or more imaging stations and the pre-charge erase station can be operated and controlled wirelessly.

Figure 4:
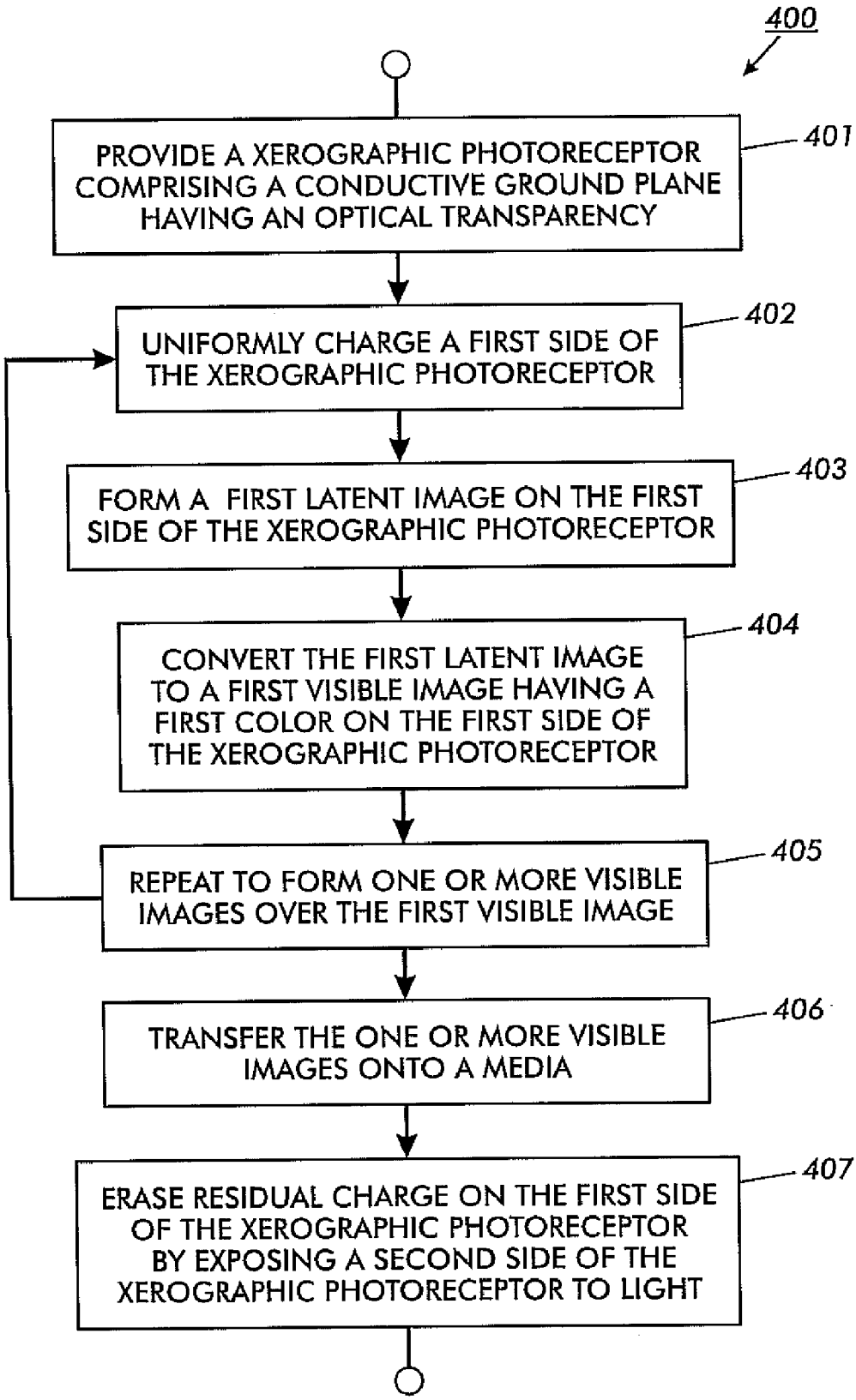
FIG. 4 illustrates an exemplary method of forming an image on image, according to various embodiments of the present teachings.

FIG. 4 illustrates an exemplary method 400 of forming an image on image. The method 400 of forming an image on image can include a step 401 of providing a xerographic photoreceptor including a conductive ground plane having an optical transparency disposed over a substrate, wherein the conductive ground plane can include a carbon nanotube layer, such that machine cycling of the xerographic photoreceptor can produce less than approximately a 10% change in the optical transparency of the conductive ground plane after about 100,000 or more machine cycles. In certain embodiments, the conductive ground plane can have an electrical surface resistivity of less than approximately 300 ohms per square and the optical transparency of more than approximately 80% in the visible to near infrared range. In some embodiments, the conductive ground plane can have the electrical surface resistivity of less than approximately 10,000 ohms per square and the optical transparency from approximately 10% to approximately 40% In some other embodiments, the conductive ground plane can have the optical transparency from approximately 40% to approximately 97%.

In various embodiments, the step 401 of providing a xerographic photoreceptor can include providing a substrate and forming a carbon nanotube layer over the substrate to form a conductive ground plane having an optical transparency. In some embodiments, the step of forming a carbon nanotube layer over the substrate can include coating the substrate with a dispersion including a plurality of carbon nanotubes and one or more of polymers and surfactants. In other embodiments, the step of forming a carbon nanotube layer over the substrate can include forming a first layer of the conductive carbon nanotube network by coating the substrate with a carbon nanotube dispersion, wherein the first layer of conductive carbon nanotube network can have an electrical conductivity and forming a second layer of polymeric coating over the first layer of conductive carbon nanotube network, wherein the second layer of polymeric coating can stabilize the first layer of conductive carbon nanotube network without changing the electrical conductivity of the first layer of conductive carbon nanotube network.

The method 400 of forming an image on image can also include uniformly charging a first side of the xerographic photoreceptor, as in step 402 and forming a first latent image on the first side of the xerographic photoreceptor, as in step 403. In some embodiments, the step 403 of forming a first latent image on the first side of the xerographic photoreceptor 301 can include forming a first latent image on the first side of the xerographic photoreceptor 301 by exposing the xerographic photoreceptor 301 from the first side using an imaging station 372 disposed on the first side of the xerographic photoreceptor 301, as shown in FIG. 3. In other embodiments, the step 403 of forming a first latent image on the first side of the xerographic photoreceptor 501 can include forming a first latent image on the first side of the xerographic photoreceptor 501 by exposing the xerographic photoreceptor 501 from a second side using an imaging station 572 disposed on the second side of the xerographic photoreceptor 501, as shown in FIG. 5, wherein the second side is opposite to the first side. The method 400 of forming an image on image can also include converting the first latent image to a first visible image having a first color on the first side of the xerographic photoreceptor, as in step 404. In various embodiments, the steps 402, 403, and 404 can be repeated as in step 405 to form one or more visible images over the first visible image, wherein each of the one or more visible images has a unique color. In various embodiments, the step 405 of forming one or more visible images over the first visible image having a first color can include forming a second visible image having a second color over the first visible image, forming a third visible image having a third color over the second visible image, and forming a fourth visible image having a fourth color over the third visible image. In certain embodiments, the first color can be magenta, the second color can be yellow, the third color can be cyan, and the fourth color can be black. The method 400 of forming an image on image can also include transferring the one or more visible images onto a media, as in step 406, wherein media can include, but is not limited to paper. The method 400 can also include step 407 of erasing residual charge on the first side of the xerographic photoreceptor, by exposing the second side of the xerographic photoreceptor to light.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising."

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A xerographic photoreceptor comprising:

a substrate;

a conductive ground plane having an optical transparency with a second side disposed over the substrate, the conductive ground plane comprising a carbon nanotube layer; and a photosensitive layer disposed over a first side of the conductive ground plane, the photosensitive layer comprising a charge generator material and a charge transport material, the photosensitive layer erasable by exposing the second side of the conductive ground plane to light.

2. The xerographic photoreceptor of claim 1, wherein the optical transparency of the conductive ground plane is from approximately 10% to approximately 40%.

3. The xerographic photoreceptor of claim 1, wherein the optical transparency of the conductive ground plane is from approximately 80% to approximately 97%.

4. The xerographic photoreceptor of claim 1, wherein the conductive ground plane further comprises:

a first layer of conductive carbon nanotube network disposed over the substrate, the first layer of conductive carbon nanotube network having an electrical conductivity; and a second layer of polymeric coating disposed over the first layer of conductive carbon nanotube network, wherein the second layer of polymeric coating stabilizes the first layer of conductive carbon nanotube network without changing the electrical conductivity of the first layer of conductive carbon nanotube network.

5. The xerographic photoreceptor of claim 1, wherein the substrate is a flexible belt.

6. The xerographic photoreceptor of claim 5 further comprising a ground strip layer electrically connected to the conductive ground plane, the ground strip layer comprising a carbon nanotube layer.

7. The xerographic photoreceptor of claim 1, wherein the substrate is a rigid drum.

8. The xerographic photoreceptor of claim 7, wherein the substrate comprises one or more of aluminum, aluminized plastic, paper, steel, conductive plastic, plastic, wood, ceramic, glass, recycled steel, and recycled zinc.

9. The xerographic photoreceptor of claim 1, wherein the photosensitive layer comprises:

a charge generator layer over the transparent conductive ground plane; and a charge transport layer over the charge generator layer.

10. An image forming apparatus comprising:

a xerographic photoreceptor comprising a conductive ground plane having an optical transparency disposed over a substrate, the conductive ground plane comprising a carbon nanotube layer;

one or more charging stations disposed on a first side of the xerographic photoreceptor for uniformly charging the xerographic photoreceptor;

one or more imaging stations disposed after each of the one or more charging stations to form a latent image on the xerographic photoreceptor;

one or more development subsystems disposed on the first side of the xerographic photoreceptor after each of the one or more imaging stations for converting the latent image to a visible image on the xerographic photoreceptor;

a transfer station disposed on the first side of the xerographic photoreceptor for transferring and fixing the visible image onto a media; and a pre-charge erase station disposed on the first side of the photoreceptor, the pre-charge erase station configured to expose the photoreceptor to light and to thereby erase any residual charge on the photoreceptor.

11. The image forming apparatus of claim 10, wherein the optical transparency of the conductive ground plane is from approximately 10% to approximately 40%.

12. The image forming apparatus of claim 10, wherein the optical transparency of the conductive ground plane is more than approximately 80% to approximately 97%.

13. The image forming apparatus of claim 10, wherein the conductive ground plane further comprises a first layer of conductive carbon nanotube network disposed over the substrate, the first layer of conductive carbon nanotube network having an electrical conductivity and a second layer of polymeric coating disposed over the first layer of conductive carbon nanotube network, wherein the second layer of polymeric coating stabilizes the first layer of conductive carbon nanotube network without changing the electrical conductivity of the first layer of conductive carbon nanotube network; and wherein the photosensitive layer further comprises a charge generator material and a charge transport material.

14. The image forming apparatus of claim 10, wherein the one or more imaging stations are disposed on a second side of the xerographic photoreceptor, wherein the second side is opposite to the first side.

15. The image forming apparatus of claim 10, wherein one of the one or more erase station are disposed after each of the one or more development subsystems on the second side of the xerographic photoreceptor.

16. The image forming apparatus of claim 10, wherein the substrate is a flexible belt.

17. The image forming apparatus of claim 16 further comprising a ground strip layer electrically connected to the conductive ground plane, the ground strip layer comprising a carbon nanotube layer.

18. The image forming apparatus of claim 10, wherein the substrate is a rigid drum.

19. The image forming apparatus of claim 18, wherein the substrate comprises one or more of aluminum, aluminized plastic, paper, steel, conductive plastic, plastic, wood, ceramic, glass, recycled steel, and recycled zinc.

20. A method of forming an image on image, the method comprising:

(a) providing a xerographic photoreceptor comprising a conductive ground plane having an optical transparency with a second side of the conductive ground plane disposed over a substrate, the conductive ground plane comprising a carbon nanotube layer, and a photosensitive layer disposed over a first side of the conductive ground plane;

(b) uniformly charging a first side of the xerographic photoreceptor;

(c) forming a first latent image on the first side of the xerographic photoreceptor;

(d) converting the first latent image to a first visible image having a first color on the first side of the xerographic photoreceptor;

(f) repeating steps (b)-(d) to form one or more visible images over the first visible image, wherein each of the one or more visible images has a unique color;

(g) transferring the one or more visible images onto a media; and (e) erasing residual charge on the first side of the xerographic photoreceptor by exposing the second side of the conductive ground plane to light, wherein the second side is opposite to the first side.

21. The method of claim 20, wherein the step of providing a xerographic photoreceptor comprises:

providing a substrate; and forming a carbon nanotube layer over the substrate to form a conductive ground plane having an optical transparency.

22. The method of claim 21, wherein the step of forming a carbon nanotube layer over the substrate comprises coating the substrate with a dispersion comprising a plurality of carbon nanotubes and one or more of polymers and surfactants.

23. The method of claim 21, wherein the step of forming a carbon nanotube layer over the substrate comprises:

forming a first layer of the conductive carbon nanotube network by coating the substrate with a carbon nanotube dispersion, wherein the first layer of conductive carbon nanotube network has an electrical conductivity; and forming a second layer of polymeric coating over the first layer of conductive carbon nanotube network, wherein the second layer of polymeric coating stabilizes the first layer of conductive carbon nanotube network without changing the electrical conductivity of the first layer of conductive carbon nanotube network.

24. The method of claim 20, wherein the step of forming a first latent image on the first side of the xerographic photoreceptor comprises forming a first latent image on the first side of the xerographic photoreceptor by exposing the xerographic photoreceptor from the second side.

25. The method of claim 20, wherein the step of forming one or more visible images over the first visible image having a first color comprises:

forming a second visible image having a second color over the first visible image;

forming a third visible image having a third color over the second visible image; and forming a fourth visible image having a fourth color over the third visible image.

* * * * *